US006591439B2

(12) United States Patent
Whah et al.

(10) Patent No.: US 6,591,439 B2
(45) Date of Patent: Jul. 15, 2003

(54) CONTROL FOR AN AUTOMATIC WASHER WITH SPRAY PRETREATMENT

(75) Inventors: Kenneth N. Whah, Porter, IN (US); John W. Euler, St. Joseph, MI (US); Robert J. Pinkowski, Baroda, MI (US); John Carl Aldrin, Lake Bluff, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 105 days.

(21) Appl. No.: 09/899,672

(22) Filed: Jul. 5, 2001

(65) Prior Publication Data

US 2001/0047670 A1 Dec. 6, 2001

Related U.S. Application Data

(62) Division of application No. 09/338,213, filed on Jun. 22, 1999, now Pat. No. 6,269,666.

(51) Int. Cl.[7] ..... D06F 33/02

(52) U.S. Cl. ..... 8/159; 68/12.02; 68/12.04; 68/12.05; 68/12.21

(58) Field of Search ..... 68/12.02, 12.04, 68/12.05, 12.06, 12.01, 12.12, 12.21; 8/158, 159

(56) References Cited

U.S. PATENT DOCUMENTS 5,144,819 A * 9/1992 Hiyama et al.
5,208,931 A * 5/1993 Williams et al.
5,577,283 A * 11/1996 Badami et al.
5,669,095 A * 9/1997 Dausch et al.
5,669,250 A * 9/1997 Dausch et al.
5,671,493 A * 9/1997 Moon
5,720,064 A * 2/1998 Koo
5,768,728 A * 6/1998 Harwood et al.
5,987,679 A * 11/1999 Won
6,023,950 A * 2/2000 Battistella

FOREIGN PATENT DOCUMENTS

JP 2-77291 * 3/1990
JP 2-164393 * 6/1990
JP 4-17898 * 1/1992

* cited by examiner

*Primary Examiner*—Frankie L. Stinson
(74) *Attorney, Agent, or Firm*—Thomas J. Roth; Robert O. Rice; Stephen Krefman

(57) ABSTRACT

This invention relates a control for an automatic washer incorporating a spray pretreatment or stain care cycle. In order to manage the occurrence of the condition of suds lock, the state of the washing machine related to the suds lock condition during spray pretreatment is determined by one or more of a number of methods. With this information concerning the state of the spray pretreatment process, the occurrence of suds lock can be ascertained and the cycle can be controlled accordingly to minimize negative effects resulting from a prolonged suds lock condition. Additionally, with certain information related to the occurrence of suds lock, steps can be taken during the spray pretreatment portion of the cycle to avoid the condition of suds lock altogether. Using the same primary process for measuring suds lock, load size can also be ascertained. Information about load size can be used to control the wash cycle.

6 Claims, 7 Drawing Sheets

CONTROL FOR AN AUTOMATIC WASHER WITH SPRAY PRETREATMENT

This application is a divisional of Ser. No. 09/338,213 Jun. 22, 1999. Now U.S. Pat. No. 6,269,666.

BACKGROUND OF THE INVENTION

The present invention relates to automatic washers, either of the front-loading or top-loading types, and more particularly to an improved washing system and control therefor.

Automatic clothes washers generally include fluid handling systems for filling a washer tub with a wash fluid consisting of a water and detergent solution, tumbling or agitating a wash load of fabrics for a period of time, then draining the wash fluid from the tub. A portion of the washing part of the cycle may include a spray treatment or pretreatment of the fabrics while the basket is spinning. A subsequent rinse with fresh water and draining of the rinse water are also provided. All or part of the rinse cycle may include a spray rinse of the fabrics while the basket is spinning at high speed.

Spray treatment of fabrics during the wash cycle therefore is known. Spray treatment may be desirable in a clothes washer because of known benefits such as improved washing performance and reduced energy and water usage. An example of a clothes washer having spray treatment is disclosed in U.S. Pat. No. 5,271,251 for example, assigned to the assignee of the present invention. In this example, however, a probe sensor provides a signal for the purpose of maintaining a predetermined water level during recirculation. Alternatively, a pressure dome or temperature thermistor may be used to detect the water level and a determination may be made for the level of water to be used in the following swirl portion of the cycle. However, there is no determination made of the amount of fabric load contained within the washer using the on or off times of the inlet valve or valves or the information provided by the pressure sensor.

There are known disadvantages to spray treatment as well. One undesirable condition which has been found to occur during a spray pretreatment portion of the wash cycle is 'suds lock'. When this condition occurs, contact of the fluid with the spinning basket acts to further increase the amount of suds which thus raises the height of the sudsy fluid toward the basket. The eventual result of this unstable process is that suds build up beyond the bottom of the basket and climb between the sides of the basket and tub. This large amount of suds acting between the spinning basket and the fixed tub produces a significant drag force on the basket. This drag force is large enough to cause the clutch to slip and thus causing the basket to slow down considerably. This slipping of the clutch due to excessive suds between the spinning basket and the tub is called 'suds lock'.

Certain combinations of environmental factors have been found to increase the likelihood of suds lock. Such combinations of very small loads or no load, very large doses of detergent, liquid detergent, type of detergent and soft water have been found to increase the formation of suds during the spray pretreat cycle. Also, if the means by which the amount of water controlled during the spray pretreatment cycle is not robust, suds lock may be more likely. To guard against both worst case conditions or machine degradation over time, a control for sensing suds lock and controlling the machine based on suds lock information is desirable.

U.S. Pat. No. 4,784,666, assigned to the assignee of the present application, discloses a high performance washing process for vertical axis automatic washers which includes the recirculation of wash fluid prior to the agitate portion of the wash cycle. That patent describes, as a particular embodiment of the invention, to load a charge of detergent into the washer along with a predetermined amount of water, preferably prior to admitting a clothes load into the basket to assure that the concentrated detergent solution will initially be held in a sump area of the wash tub so that the detergent will be completely dissolved or mixed into a uniform solution before being applied to the clothes load. It is also suggested that the addition of an anti foaming agent may be desirable. No particular arrangement is provided for mixing the detergent and water to provide a uniform solution, nor is any particular means described for assuring that the amount of wash liquid within the tub during the spin wash portion of the wash cycle is an appropriate amount which is slightly in excess of the saturation level for the clothes load.

U.S. Pat. Nos. 5,219,370 and 5,233,718, assigned to the assignee of the present invention, disclose variations on a high performance washing process for vertical or horizontal axis automatic washers which include the recirculation of wash fluid prior to the agitate portion of the wash cycle or other washing or rinsing steps. The primary means for controlling water input into the systems is to detect water level using a liquid level sensor. It is suggested that a pressure dome sensor may be used to detect an oversudsing condition, however this would be performed in conjunction with usage of the liquid level sensor, which is not provided for in the present invention. These patents allow for the possibility of indirectly inferring the water level in the tumble portion of the cycle based on the sensed level of detergent liquor in the pretreatment portion, unlike the present invention which determines the amount of clothes load and possibility of suds lock.

SUMMARY OF INVENTION

The present invention provides a control for sensing the state of the washing machine during a pretreatment cycle having a combined spray and high speed spin. During such a pretreatment cycle the washer is susceptible to the possible occurrence of a suds lock condition, which may be detected and handled by the present invention. This can be accomplished by a variety of sensing techniques, through which the possible or imminent occurrence of suds lock can be determined or inferred, including sensing the condition of the wash liquid or the washing machine components. A suds lock condition may even be anticipated and avoided by the present invention. Further, by knowing that a suds lock condition is occurring or is likely to occur, the spray pretreatment portion of the wash cycle can be preterminated and the rest of the cycle can be continued. Alternatively, adding of water may be discontinued. By following a suds lock condition immediately with a deepfill of the tub of the automatic washer, suds buildup within the basket can be minimized.

By using the same technique of measuring suds lock, the size of the load can also be ascertained. This information can thus be applied to control the rest of the cycle. For example, the automatic deepfill water level and relative agitation rate can be altered according to the sensed size of the load. In the present invention, the load size is determined regardless of the types of fabric materials contained in the load. As well, in certain load conditions such as large loads, the deepfill portion may be slightly altered in order to optimize and maximize the wash performance. This may be performed not only as a result of detecting the load size but also as a result of user control inputs.

Furthermore, the control may be used to detect special conditions, for example unusually wet laundry at the outset of the wash cycle or failure in some aspect of the wash cycle.

DETAILED DESCRIPTION OF THE PREFERRED EMBODIMENTS

Figure 1:
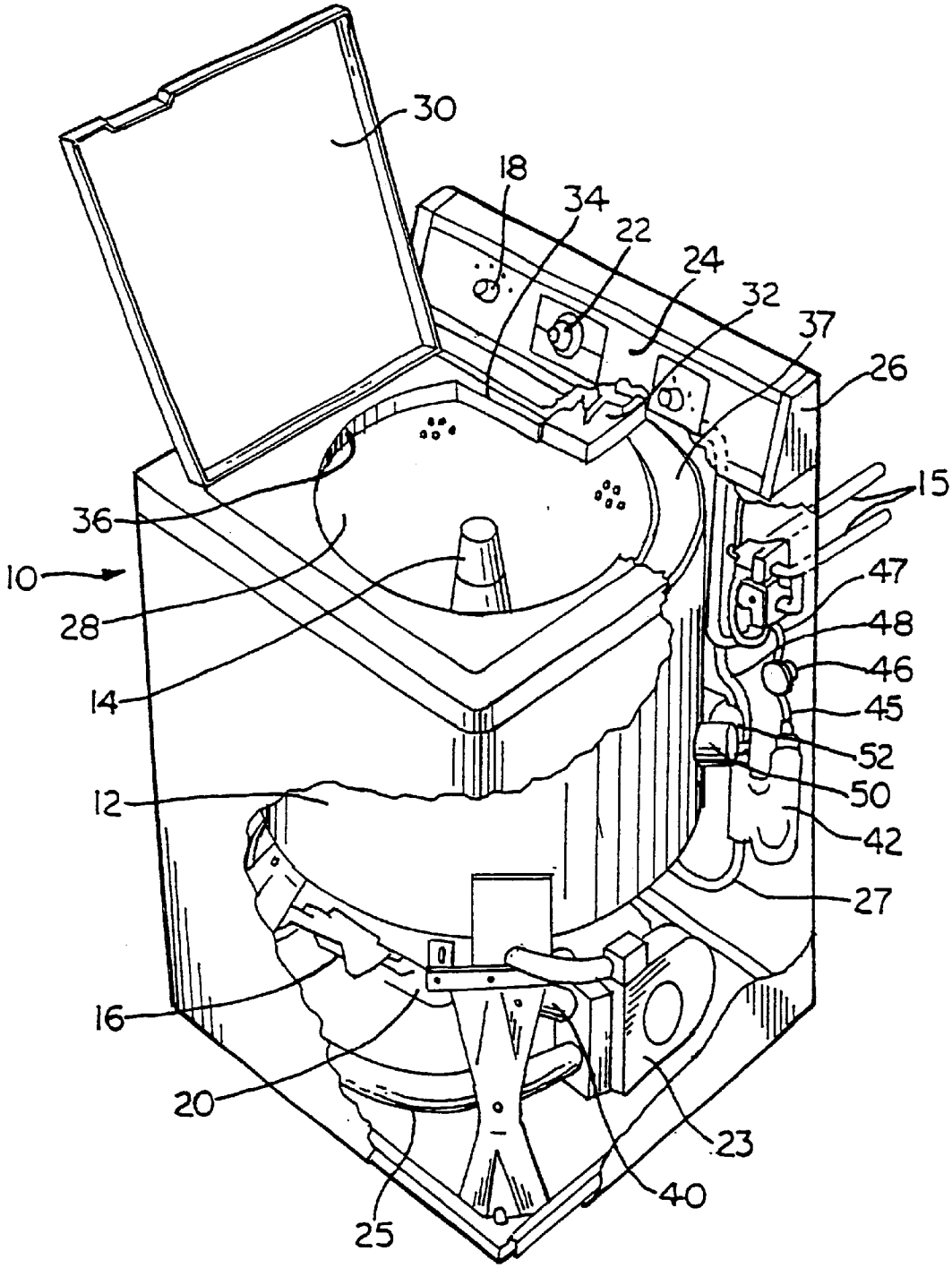
FIG. 1 is a perspective view of a partially cut away automatic washer containing recirculation hardware embodying the principles of the present invention.

In FIG. 1 a washing machine is generally shown at 10 which has a tub 12 with a vertical agitator 14 therein, a water supply 15, a power supply (not shown), an electrically driven motor 16 operably connected via a transmission 20 to the agitator 14 and controls 18 including a presettable sequential control device 22 for use in selectively operating the washing machine 10 through a programmed sequence of washing, rinsing and extracting steps. A water level setting control 18 is provided for use in conjunction with control device 22. A fully electronic control having an electronic display (not shown) may be substituted for control device 22. The control device 22 is mounted to a panel 24 of a console 26 on the washing machine 10. A rotatable and perforate wash basket 28 is carried within the tub 12 and has an opening 36 which is accessible through an openable top lid 30 of the washer 10. Tub ring 37 is positioned overlying wash basket 28 and tub 12.

The invention disclosed herein is not necessarily limited to implementation in a vertical axis washing machine as shown in the figures. Inasmuch as the invention is a washing machine having a unique control and recirculating spray wash arrangement, the invention may be equally applied in a horizontal or tilted axis washing machine. Moreover, in the specific application of the invention in a vertical axis washing machine, the invention may be practiced in a variety of machines which may include different motor and transmission arrangements, pumps, recirculation arrangements, agitators or impellers, or controls.

A sump hose 40 is fluidly connected to a sump (not shown) contained in a lower portion of tub 12 for providing a wash fluid recirculating source. Pressure dome 42 receives the recirculating fluid which exits via recirculating spray nozzle hose 48 which is fluidly connected to recirculating spray nozzle 32. A pressure sensor or transducer 46 detects fluid pressure within pressure dome 42 and provides an output signal via lines 47 to the control, the signal varying dependent upon the sensed dynamic pressure. A second air dome 50 having a deepfill pressure sensor or transducer optionally provides a second pressure signal indicating static pressure to the control via lines 52.

As described herein, a pressure sensor may be a pressure switch having predetermined pressure levels that, within certain limits, will provide one or more signals to control 22 that a certain pressure has been achieved. Depending on the presence or absence of such signals, the control will receive and store or process such information, as is well known. Alternatively, a transducer may be used to sense pressure and provide a signal of varying frequency or voltage to control 22 indicating the pressure levels detected.

Figure 2:
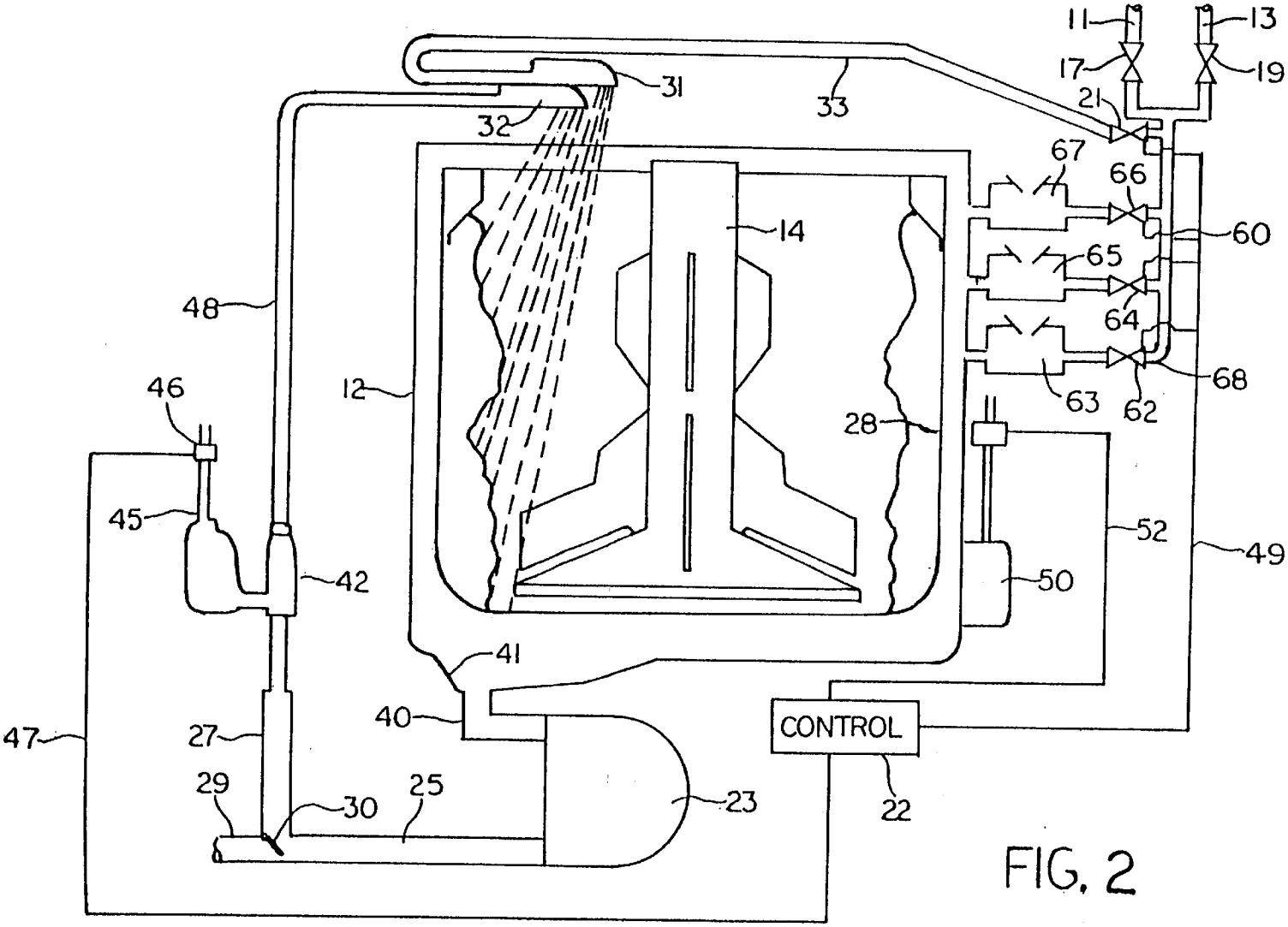
FIG. 2 is a schematic diagram of an automatic washer portraying in fluid circuit form the recirculation hardware and control arrangement embodying the principles of the present invention.

In FIG. 2 a schematic diagram further describes an example of a washing machine incorporating the present invention. Hot water inlet 11 and cold water inlet 13 are controlled by hot water valve 17 and cold water valve 19, respectively. Valves 17 and 19 are selectably openable to provide fresh water to feed line 60. A spray nozzle valve 21 is fluidly connected to feed line 60 for selectably providing fresh water to tub 12 when desired. This fresh water is delivered by fresh water spray nozzle 31 via fresh water hose 33. Valves 17 and 19 are openable individually or together to provide a mix of hot and cold water to a selected temperature.

Upon opening one or both of valves 17 and 19, fresh water is selectably provided to a series of dispenser valves via feed line 60. Valve 62 selectably provides fresh water to detergent dispenser 63, valve 64 selectably provides fresh water to bleach dispenser 65, and valve 66 selectably provides fresh water to softening agent dispenser 67.

As further shown in FIG. 2, the washing machine includes a wash liquid recirculation system. In order to recirculate wash liquid for the recirculating spray wash, tub sump 41 collects wash liquid and is fluidly connected to pump 23 by sump hose 40. Pump 23 is selectably operational to pump liquid from tub sump 41 via pump outlet hose 25 either to recirculating hose 27 or drain hose 29 depending on the position of bidirectional valve 30. Recirculating hose 27 provides recirculating wash liquid to pressure dome 42, the wash liquid exiting the pressure dome 42 via recirculating spray nozzle hose 48 and being emitted to the wash basket 28 via recirculating spray nozzle 32.

Pressure dome 42 provides a head of pressure varying dependent upon the amount of wash liquid contained in the recirculating wash system by maintaining a captured dome of air in communication with the recirculating wash liquid. The pressure dome 42 provides a channel for the captured air to keep in contact with pressure sensor 46 via pressure line 45.

Pressure sensor 46 provides optionally either an on/off or a varying or dynamic signal to control 22 via lines 47, the signal varying dependent on the sensed pressure of the recirculating wash liquid. Control 22 also optionally receives a static pressure signal from deepfill transducer dome 50 via lines 52 for signaling the level of wash liquid within wash tub 12, however the invention disclosed herein may be practiced without use of a deepfill pressure dome. Control 22 is further operable to receive input signals via lines 49, including signals from valves 21, 62, 64 and 66 providing on and off times for these valves.

By sensing the air pressure within pressure dome 42, the amount of recirculating wash liquid in the washing machine may be inferred. This information is useful to determine the amount of free water in the washing machine during a recirculating wash. Thereby, the amount of clothing in the washing machine may be inferred, which information is useful in order to minimize water and energy usage during a spray pretreatment cycle, stain cycle or other recirculating wash cycle, and further during later or other portions of the cycle. Also, the suds lock condition, or absence thereof during portions of a cycle may be determined. Suds lock may be prevented by limiting recirculating wash liquid to slightly in excess of clothes saturation.

Figure 3:
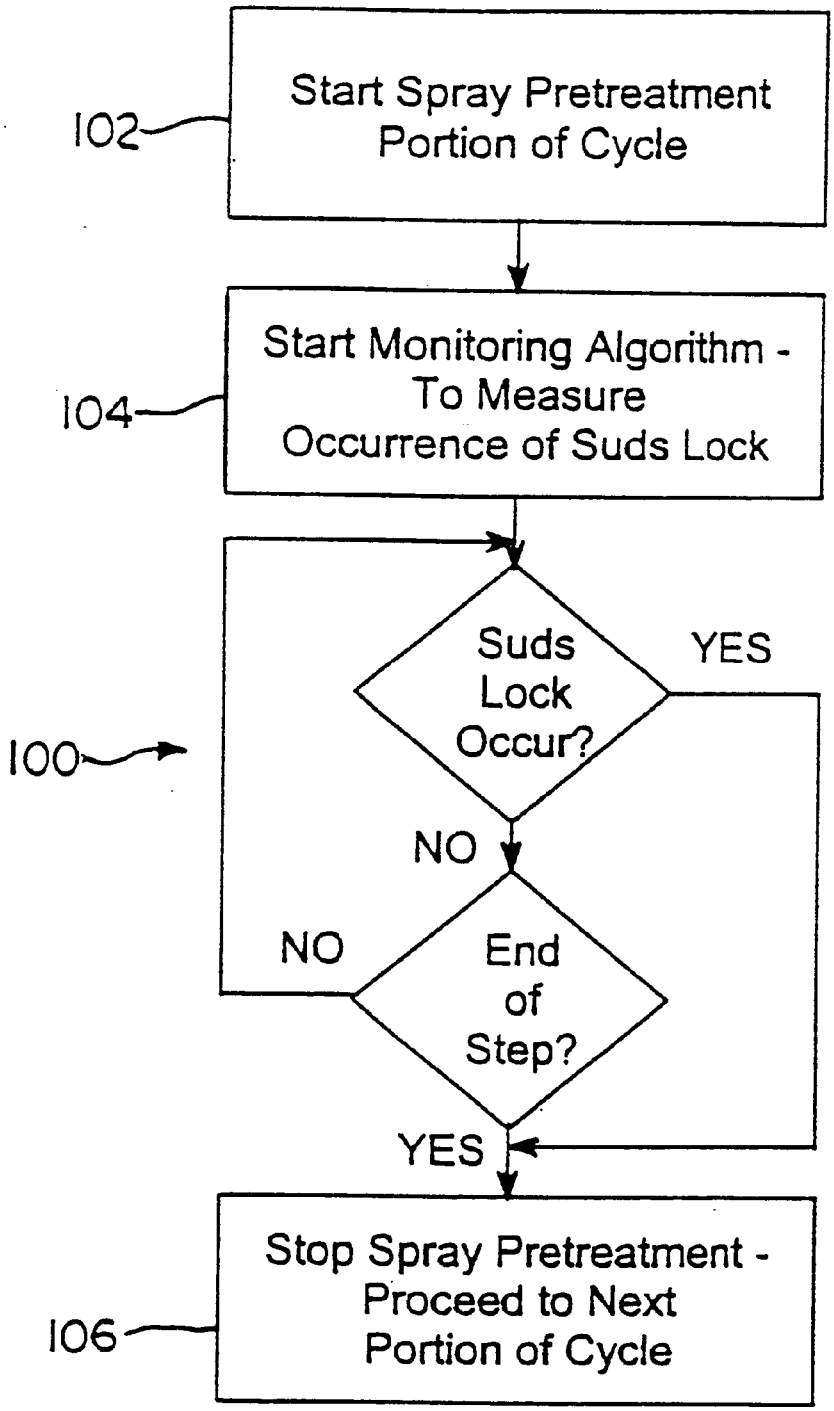
FIG. 3 is a block diagram of the process for controlling the spray pretreatment portion of the wash cycle based on monitoring the condition of suds lock occurrence.

A basic process for the new control scheme of the spray pretreatment portion of the wash cycle is shown in the block diagram 100 in FIG. 3. The process begins at the commencement of spray treatment 102 by starting monitoring of the suds lock algorithm 104. The process simply either completes the full cycle if suds lock does not occur or skips through the rest of the pretreatment cycle and onto the next step 106 in the case that suds lock should occur. This process 100 is independent of the method by which the existence of suds lock is determined.

Figure 4A:
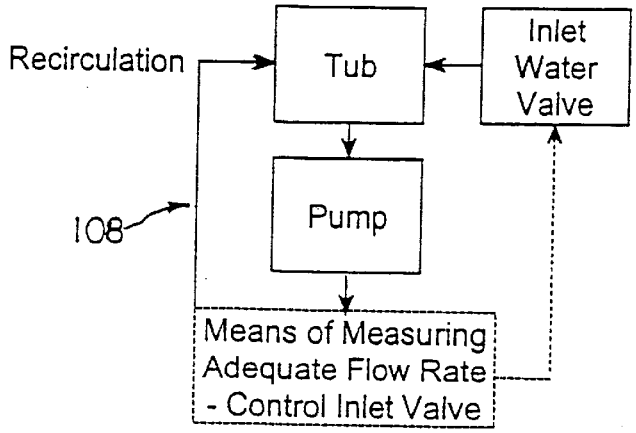
FIG. 4*a* is a block diagram of an automatic washer containing recirculation hardware using flow rate information to control the amount of water added during the spray pretreatment portion of the wash cycle.

Several methods can be applied in order to ascertain the existence of suds lock. FIG. 4*a* displays a block diagram 108 of the automatic washer containing recirculation hardware where a measure based on the flow rate of the wash liquid recirculation line is used to ascertain when water is added to the recirculation system. The flow rate can be measured in one of a number of known ways. A flow washer 68 contained in detergent dispenser valve 63 controls the flow rate within a predetermined range for a variety of predictable inlet water pressures. Limiting flow in this manner allows the flow rate to be inferred based upon the on time of the inlet valve. A flow meter may also be used. Finally, the deep fill rate may also be discerned.

This intermittent process is due to the dry clothes load absorbing water into the load and thus the system requiring more water to regain the necessary flow rate. A similar approach is shown in a block diagram 110 in FIG. 4*b* which shows that determining when water needs to be added to the system can be performed by any of various techniques capable of measuring the height of the wash fluid in the sump portion of the tub. Alternatively, a pressure sensor may be used to determine whether one or more predetermined pressure levels have been reached. In either case, if the control determines that the necessary wash fluid amount recirculating within the washer is satisfied, the control discontinues adding water by intermittent closing of the water inlet valve.

Detecting Load Size During Pretreatment Portion of Cycle

Figure 4B:
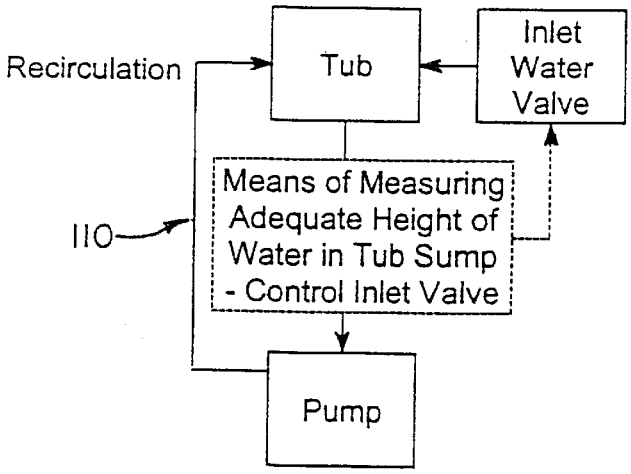
FIG. 4*b* is a block diagram of an automatic washer containing recirculation hardware using height of water in the tub sump information to control the amount of water added during the spray pretreatment portion of the wash cycle.
Figure 5:
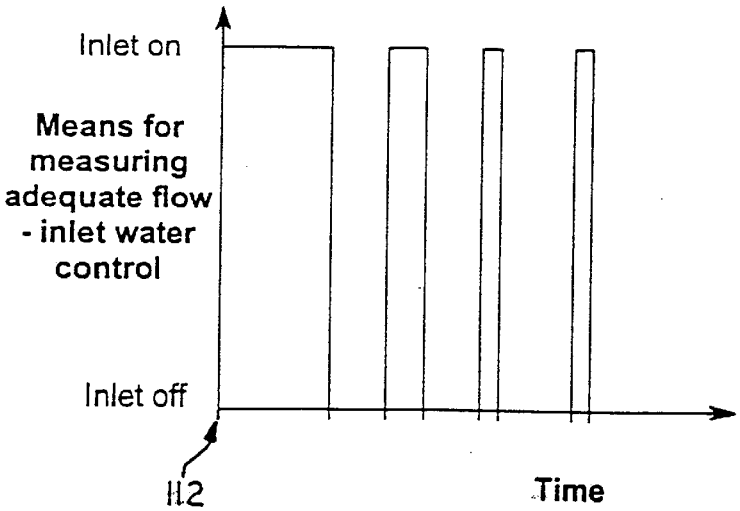
FIG. 5 is a plot displaying the typical form by which the inlet valve is controlled based on measured information.

Using either of these means shown in FIGS. 4*a* or 4*b* to control the process of adding water to the system, an alternating pattern of the times for the addition of water to the system and not adding water to the system can be gained. FIG. 5 shows such a typical pattern or profile 112 relating to the on and off periods of the inlet valve for the spray pretreatment portion of the automatic wash cycle, based on whether the water level or water pressure detecting means is satisfied. Preferably, the control determines the necessary amount of wash liquid as that amount which is slightly in excess of the saturation level for the clothes load.

Accordingly, as the pretreatment portion of the cycle proceeds as shown in FIG. 5, the control continually monitors the inlet on or off times or both on and off times, or the pressure or water level signals which are used to control the inlet on, off or on and off times. This information, as discussed later herein, may be used to determine whether the clothes washer is experiencing a suds lock condition or some other abnormal condition if the information is outside a certain expected range. As well, however, this information may be used to determine the load size being washed, so that the pretreatment cycle and later portions of the wash cycle may be altered and preferably optimized or adapted to effectively complete the cleaning and rinsing of the clothes, but no more in order to avoid suds lock.

Pretreatment Cycle Control Based on Load Size Measurement

By using the measure of load size during the pretreatment cycle, the rest of the pretreatment cycle can be optimized based on the load size information. After the desired water level or pressure is detected as initially satisfied by the control 22, the washing machine is allowed to continue the normal pretreatment cycle where water is added to the system as requested by the control system for a first predetermined time. The control then identifies the load size in a manner as previously discussed. The inlet valve may be shut off regardless of whether water is called for by the control system when a second predetermined time is reached. This second predetermined time may be defined based on the load size measure. At this time, the pretreatment step is completed and the machine proceeds through the rest of the cycle. The process of not adding water will aid the system in avoiding suds lock which increases the performance of the cycle.

In another example of optimizing the rest of the pretreatment cycle based on the load size information, the control system determines the total water fill times at preselected intervals. Depending on the total water fill time, a preselected overall cycle time for pretreatment is performed, during which water may be added. The cycle is further optimized by taking into consideration the water level and cycle selected by the user, so that the washer may perform not only according to the load size detected but in accordance with the demands of the user.

Total Cycle Control based on Load Size Measurement

From the various means of determining load size during the pretreatment portion of the cycle, this information can be applied to control other portions of the cycle. In previous washers, the load size or water level input on the console is the input used to control the amount of water added to the system in the deep fill and the relative agitation rate based on the type of cycle chosen. In the present invention, the load size determined from the pretreatment step can be applied in a similar way to determine water amounts and control the agitation performed during the rest of the wash cycle. For example, the load size information can be used to determine the agitation length and rate, to determine the deep fill wash length, spin time and speed, the deep fill or spray rinse length, spin time and speed, or the number of rinses.

An automatic washer incorporating the present invention may preferably include traditional user control inputs such as cycle, water temperature and water level. Although the input by the consumer may be taken into consideration to affect the cleaning cycle, the control selectively processes the previously mentioned inlet on, off or on and off, water level or pressure information independently of such user input to determine the size of the clothes load. It is noted that the type of clothes, particularly the variety of materials providing the makeup of the clothes is not of critical importance once the pretreatment cycle is completed, since the load size information gained during the pretreatment cycle is all that is needed to continue the wash process. However, the user input may be considered as part of an algorithm such that the performance of the washer, for example the length of wash time, is not greatly different than consumer expectations for a selected input.

In another example of optimizing the rest of the wash cycle based on detected load size, it is a known problem in a vertical axis washer to turn over a large clothes load approaching 17 pounds during a deep fill wash. One difficulty is that after filling the washer to the maximum level and beginning agitation, the large items in the load such as sheets, tablecloths or towels may be displaced above the waterline by the agitator, which physically lowers the water level in the tub. The lowering of the water level in the tub can be anticipated by control 22 or detected via a pressure sensor 46 or 50 and compensated for by adding water to return to the maximum level.

Alternatively, to address the aforementioned problem, a delayed fill may be used. When the user selects a heavy duty cycle along with maximum water level, for example the water level in the deep fill wash is initially brought to a level slightly below the maximum. The clothes load will be partially submerged, with a portion of the load remaining dry or at most partially saturated on the surface. At this water level, the agitator is allowed to commence turning and will easily pull the dry clothing from the top of the load, moving the clothes down the center of the basket and up the outside in the normal motion. After an initial preselected period, long enough to allow the load to be fully wetted and largely submerged, the washing machine may be filled to the maximum level followed by additional agitation or while continuing to agitate. The preceding process assures that normal rollover of the wash load is achieved as quickly as possible despite the large load.

Suds Lock Measuring

Figure 6:
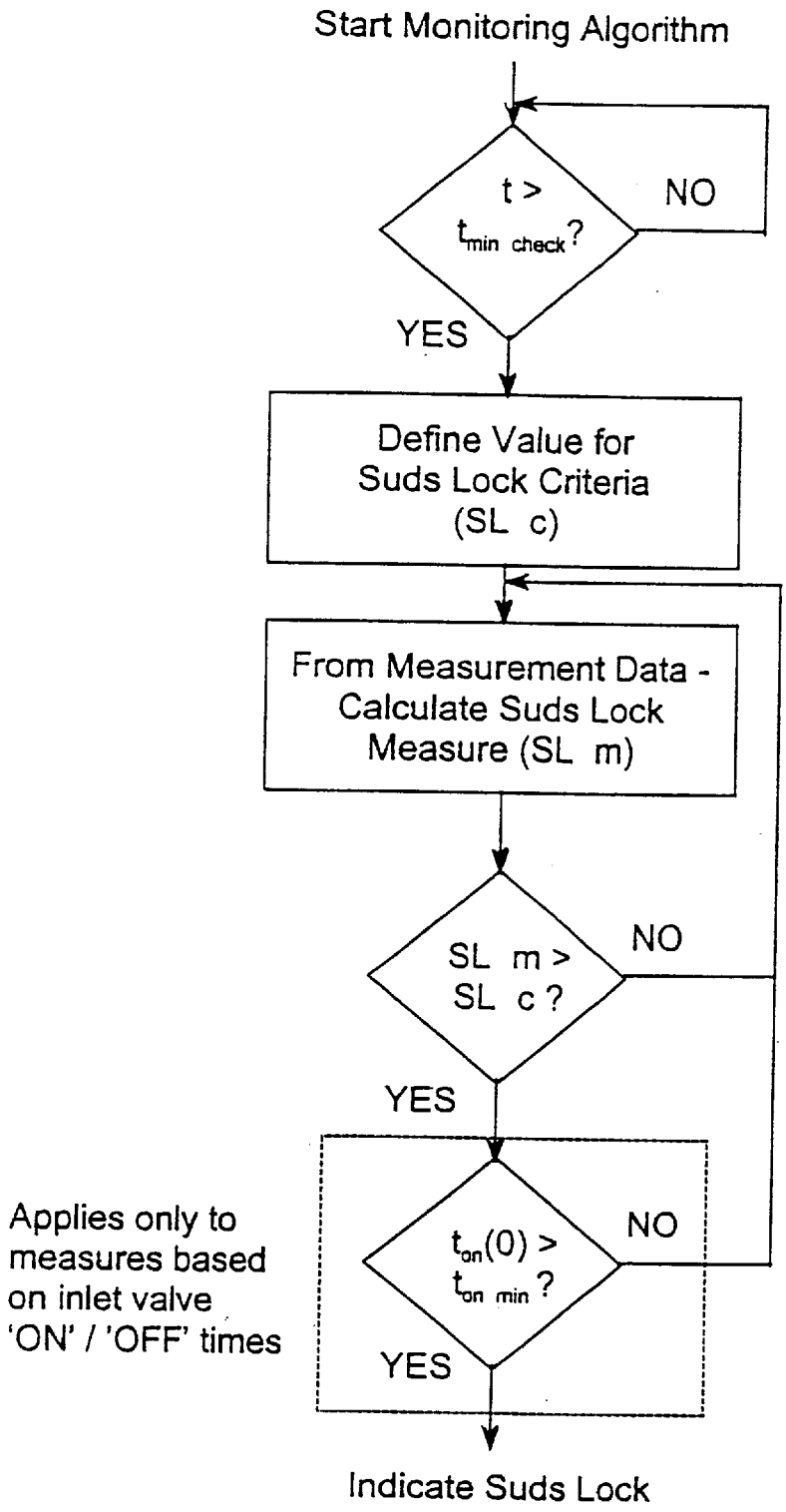
FIG. 6 is a block diagram of the general process for determining whether suds lock has occurred based on criteria and suds lock measure information.

FIG. 6 displays a block diagram 118 of the general process for determining whether suds lock has occurred based on selected criteria and suds lock measure information. This diagram is independent of chosen measurement technique. Several sets of criteria are satisfactory for the case of using information about the inlet water valve cycling information measurement of suds lock. The following table contains several functional criteria:

TABLE

Suds Lock Criteria Table for Inlet Water Valve Based Measures.

| | Suds Lock Measure | Suds Lock Criteria |
|---|---|---|
| Case (1) | $t_{on}(0)$ | 10–20 sec. |
| Case (2) | $t_{on}(0)/(t_{on}(1))$ | N |
| Case (3) | $t_{on}(0)/(t_{on}(1) + t_{on}(2))$ | N |
| Case (4) | $t_{on}(0)/(t_{on}(1) + t_{on}(2) + t_{on}(3))$ | N |

The optimum value for N is approximately 2. The algorithm also incorporates a minimum time, $t_{min_check}$, which to start checking for suds lock to occur. This time could be set between 0 sec and 40 sec. In addition to satisfying the suds lock criteria, there also is a time $t_{on_min}$ which sets a minimum time of addition which it must be above to be considered as suds lock condition. Typical ranges for this are between 2 to 4 sec.

Figure 7:
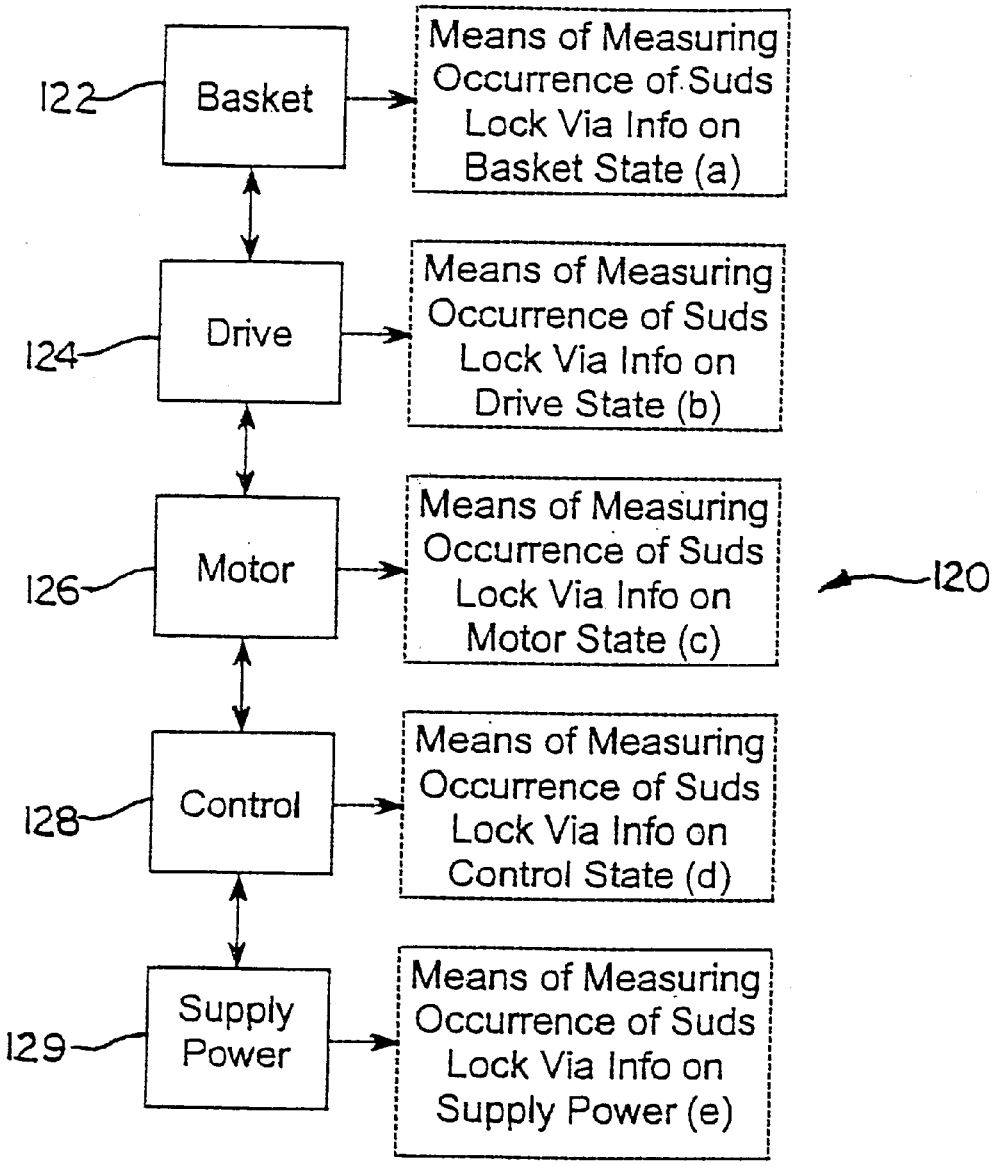
FIG. 7 is a block diagram that shows the components which make up the drive system and the corresponding means for measuring the existence of suds lock through each component.

Other ways exist for detecting suds lock in the washing machine. FIG. 7 displays a block diagram 120 that shows the components which make up the drive system and the corresponding means for detecting the existence of suds lock through each component. For the basket, the means for detecting the existence of suds lock 122 may be summarized as follows.

A first suds lock detection method is by measurement of the basket RPM (by magnetic, optical or ultrasonic means) after the basket is brought up to normal operating speed. When basket reduces RPM by 70% from the steady state value, suds lock has occurred.

A second suds lock detection method is by measurement of the basket or tub acceleration after the basket is brought up to normal operating speed. Vibration of the basket or tub should be fairly constant or increasing during the spray pretreatment portion of the cycle unless suds lock occurs.

For the drive system, the means for detecting the existence of suds lock 124 may be summarized as follows.

A first suds lock detection method is by measuring the temperature of the clutch. When a suds lock condition occurs, the temperature of the clutch will increase significantly during suds lock condition. A second suds lock detection method is by measuring torque on drive components. When a suds lock condition occurs, a significant drop in torque will occur.

For the motor, motor control and supply power, the means for detecting the existence of suds lock 126, 128 and 129 may be summarized as follows. A first suds lock detection method is by measurement of motor RPM using a tachometer which is built into the motor. When the basket reduces RPM by 70% from steady state value, suds lock has occurred. A second suds lock detection method is by measurement of the current or wattage going to the motor measured at motor. When current or wattage increase by a given percentage, suds lock has occurred.

A third suds lock detection method is by measurement of total current or wattage going to the entire machine, since motor current is by far most significant component. When current or wattage increase by a given percentage, suds lock has occurred. A fourth suds lock detection method is by measurement using an opto coupler for obtaining information about drop in the torque draw of the motor. A fifth suds lock detection method is by measurement using a ferrite core sensor for obtaining information about the drop in the torque draw of the motor. In the latter two methods, when torque drops by a given amount, suds lock has occurred.

Figure 8:
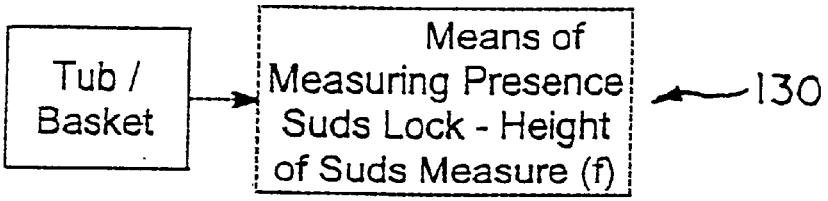
FIG. 8 is a block diagram that shows the measuring of the existence of suds lock through measuring the height of suds in the tub/basket.

In addition to measurements which can be made on the drive system, measurement of the height of the suds in the system can be made. FIG. 8 displays a block diagram 130 illustrating the components which are to be observed, that is the tub or the basket, and the means for detecting the existence of suds lock through each component. Specific embodiments of such techniques to measure the height of the suds during a spray pretreatment portion of the wash cycle may include a) providing a conductivity strip along the side of the basket; b) ultrasonic measurement, or c) optical measurement. Feedback provided to the control in each case indicates an oversuds condition, from which it may be inferred that suds lock has occurred.

Special Conditions

Figure 9:
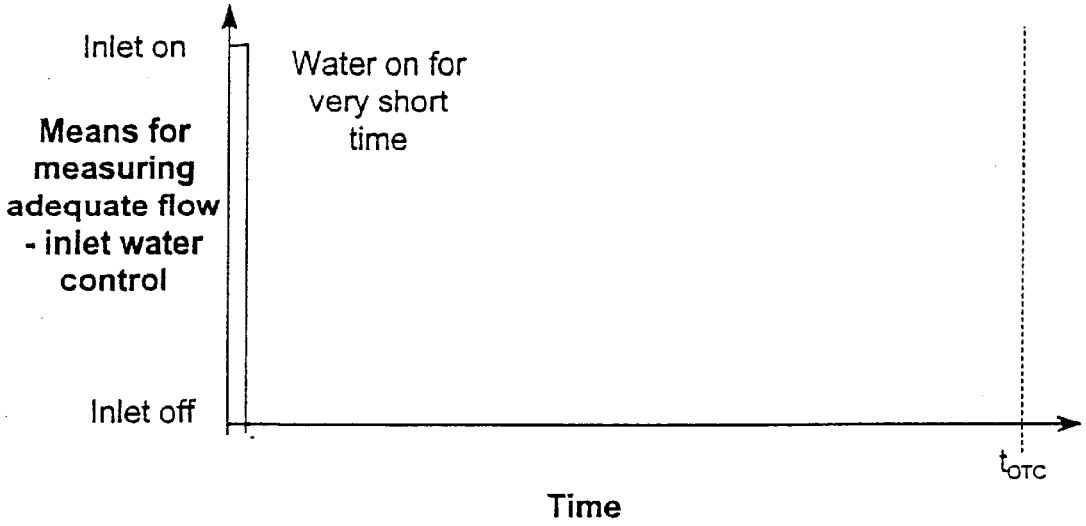
FIG. 9 is a plot displaying the process by which the inlet valve is controlled based on measured information for the special case of having too much added water in the system at the start of the cycle.

In addition to the occurrence of suds lock, there are a few special conditions which can as be detected by the control. Although other detection means may be used, in these examples the control monitors the inlet valve on time over a prescribed check time. One such condition occurs when the machine is started in pretreatment portion of the cycle with much more water than necessary. FIG. 9 displays the process by which the inlet valve is controlled based on measure information for the special case of having too much added water in the system at the start of the cycle. This condition can occur for the reasons that the user starts the machine into normal deepfill (without prefill), then stops the machine after a good amount of water has filled the machine (over 2 gallons) and the machine is switched and restarted in pretreatment cycle; the user puts a very soggy clothes load into the machine or the user physically adds water into the machine with the load.

For all these conditions, the time by which the machine calls for water will be very small. Thus by monitoring the time by which the control system calls for water with respect to some length of checking time, this condition can be ascertained. If such a case should occur, the pretreatment cycle may be ended and the rest of the cycle is continued.

Another special condition can be detected by the primary means of monitoring the inlet valve on time over a prescribed check time. One such condition may occur when the washing machine is in the recirculating spray pretreatment portion of the cycle and the machine continuously calls for water without stopping.

Figure 10:
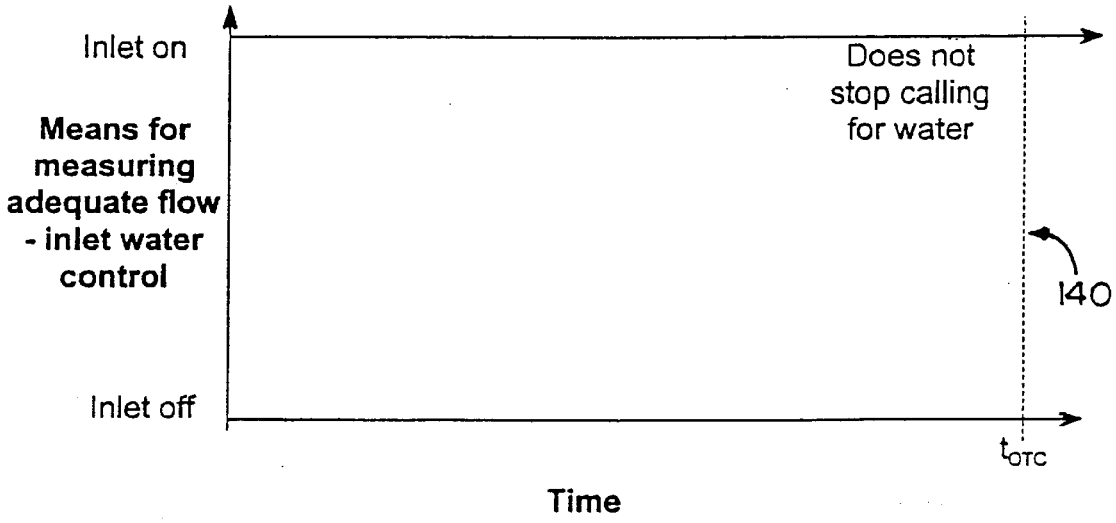
FIG. 10 is a plot displaying the process by which the inlet valve is controlled based on measure information for the special case of never satisfying the measure due to some failure condition in the machine.

FIG. 10 displays a graphic depiction 140 of the process by which the inlet valve is controlled based on measured information in the special case where the recirculation flow in the system at the start of the cycle is not satisfied for some finite period of time. In addition to sensing this condition based on the recirculation flow being not satisfied, additional information can be gained from the deepfill pressure transducer for the air dome 50 in the tub.

For the case where the deepfill pressure transducer does not sense the existence of a sizable amount of water in the tub, a variety of machine conditions may be a cause. Under the category of washing machine component failures, the failures can include a sizable leak in the tub or the recirculation or drain hose system; one or more bad inlet valves not adding water to system, or a recirculation diverter valve failed or stuck in the drain direction. Under the category of non-washing machine component failures might be a long fill due to very low line pressure.

For the case where the deepfill pressure transducer is sensing the existence of a sizable amount of water in the tub, the following machine conditions may be a cause, all of which are washing machine component failures. The failures can include a bad recirculation pressure switch, a pump or motor failure, a severe recirculation line clog or the recirculation pressure hose is disconnected.

In case of such failure, the control 22 will end the cycle and indicate the failure condition to the consumer.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of the contribution to the art.

The embodiments of the invention in which an exclusive property or privilege is claimed are defined as follows:

1. A washing machine apparatus for washing a textile wash load, the washing machine comprising:

a wash tub for receiving a wash liquid within which there is a rotatable wash zone including a peripheral wall, a motor for rotating the peripheral wall and the wash load in the wash zone about a generally vertical axis, an agitator or impeller positioned near the center area of the wash tub and operable to pull dry fabric items from the top of the wash load down the center area of the wash tub and up the perimeter of the wash tub, and a control for receiving user input and outputting predetermined commands for washing fabric items, the control including a predetermined command where upon selection of a predetermined high water level or detection of a large load, the control provides for a delayed deep fill wash including a first fill to a first predetermined level, agitation of the load by the agitator for a first period for fully wetting the wash load followed by a second fill within the wash tub to a higher water level.

2. The washing machine according to claim 1 where the control performs the delayed deep fill wash upon consumer input to the control selecting a maximum water level.

3. The washing machine according to claim 1 where the control performs the delayed deep fill wash upon consumer input to the control selecting a particular cycle.

4. A method for washing a textile wash load with a washing machine having a wash tub for receiving a wash liquid within which there is a rotatable wash zone including a peripheral wall, a motor for rotating the peripheral wall and the wash load in the wash zone about a generally vertical axis, an agitator or impeller for imparting energy to the wash load, and a control for receiving user input and outputting predetermined commands for washing fabric items, the method comprising the steps of:

receiving a user input of a selection of a high water level or detecting a large load, filling the wash tub to a first predetermined level, pulling dry fabric items from the top of the wash load down a center area of the wash tub for a first period for fully wetting the wash load, and filling the wash tub with a second fill to a higher water level.

5. The method of claim 4, wherein the step of pulling the wash load down a center area of the wash tub further comprises the step of agitating the wash load up the perimeter of the wash tub.

6. The method of claim 4, further comprising the step of soaking the wash load.

* * * * *